United States Patent [19]

Holder

[11] 3,946,182

[45] Mar. 23, 1976

[54] PUSHBUTTON ACTUATOR SWITCH WITH POP-IN HEAD

[75] Inventor: Paul Dalton Holder, Richardson, Tex.

[73] Assignee: Texas Instruments Incorporated, Dallas, Tex.

[22] Filed: Dec. 13, 1974

[21] Appl. No.: 532,665

[52] U.S. Cl. ..... 200/159 B; 200/52 R; 58/50 R

[51] Int. Cl.[2] ..... H01H 3/12

[58] Field of Search ..... 200/340, 159 B, 159 R, 200/159 A, 52 R; 58/50 R

[56] References Cited

UNITED STATES PATENTS 3,141,945 7/1964 Juggins..... 200/159 R

*Primary Examiner*—Robert K. Schaefer
*Assistant Examiner*—M. Ginsburg
*Attorney, Agent, or Firm*—Harold Levine; Edward J. Connors, Jr.; Stephen S. Sadacca

[57] ABSTRACT

A diaphragm type pushbutton actuator switch with self-contained contacts includes a pop-in head. The main switch body is mountable in a substrate or housing with an opening provided for the head. The head is then press-fittable into the main switch body for retention therein. With the head retained in the main switch body, it is movable therein to make or break electrical contact upon actuation.

12 Claims, 3 Drawing Figures

PUSHBUTTON ACTUATOR SWITCH WITH POP-IN HEAD

This invention relates to electrical pushbutton switches and, more particularly, to a pushbutton switch adapted with a pop-in head.

In certain instances, it is desirable to mount the main body of a pushbutton switch on a substrate and place a housing thereover before the actuator button is included in the switch assembly with the actuator button being insertable from the exterior of the housing. This is particularly useful where, for example, the actuator button when in place extends considerably beyond the main switch body and would otherwise be in the way of placing the housing thereover. In other instances, it is desirable because of the configuration of the housing to insert the main body of the switch into the substrate or housing from the outside of the housing with the actuator button removed and the actuator button inserted into the main body after the main body has been affixed with respect to the substrate or housing. This alternate arrangement is particularly useful where the opening for insertion of the main body is of such close tolerance that insertion would be extremely difficult if the main body of the switch were inserted with the actuator button already in place. For example, if the actuator button of the head is the same size or larger than or of a different shape than the main switch body such actuator button would be in the way of mounting or affixing the main switch body to a substrate or housing. As will be seen from the detailed description, pushbutton actuator switches in accordance with the present invention are utilized in the fabrication of electronic wrist watches to provide a display of time upon demand. The main switch body is affixable from the outside of the housing in an opening provided therefor. The pop-in head having an actuator button of close tolerance with respect to the opening and essentially larger than and of different shape than the main switch body is simply popped in after the main switch body has been affixed to the housing.

It is therefore an object of the present invention to provide an electrical pushbutton switch in which the actuator button is insertable and retainable by the main switch body after the main switch body has been mounted with respect to a housing.

It is another object of the invention to provide a pushbutton switch in which the actuator button is insertable, self-retainable and movable in a main body of the switch.

It is a further object of the invention to provide a novel pushbutton switch with self-contained contacts including an actuator button which is insertable into the main body after the main body and contacts and bias means have been assembled.

These and other objects are achieved in accordance with the present invention by providing a pushbutton actuator switch with self-contained contacts and a pop-in head. The main switch body is mountable on a substrate or in a housing, preferably within a cavity provided therefor. The head, which includes a shaft and retention member such as retaining ring, is press-fittable into the main switch body which includes spring members which bias in response to force applied by one edge of the retaining ring to allow passage of the retaining ring and spring back to a normal unbiased position for retention of the pop-in head by means of the opposite edge of the retaining ring. Once the head is retained in the main switch body, the head is movable therein to make or break electrical contact upon actuation.

A preferred embodiment includes a conductive diaphragm member which is self-biasing and makes electrical contact with a contact member upon actuation of the actuator button of the pop-in head which applies force thereupon. In one embodiment, contact is provided to the casing of the main switch body to the conductive diaphragm member which makes or breaks a conductive path between the main switch body and the contact member. The main body of the pushbutton switch may be mounted in a housing or substrate and it is preferably press-fit in a close tolerance cavity within the housing or substrate. If the main body is mounted on a substrate, a housing having an opening for the pushbutton actuator may be placed over the main switch body before insertion of the pop-in bead.

These and other objects and advantages of the invention will become more apparent from the detailed description and claims and from the accompanying drawings wherein:

Figures 1, 2, 3:
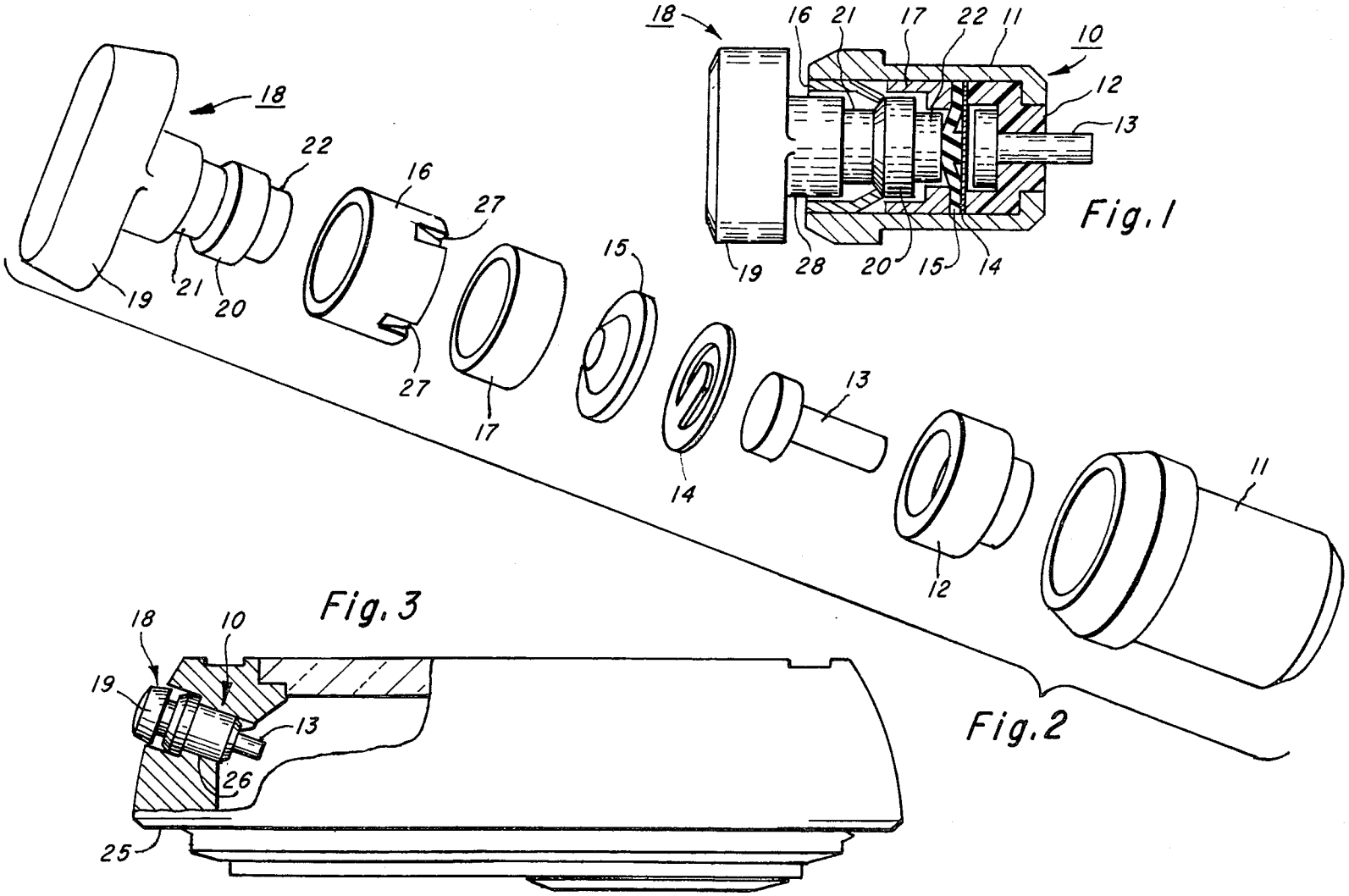
FIG. 1 is a cross-sectional view of an embodiment of a pushbutton actuator switch in accordance with the present invention.
FIG. 2 is an exploded view in perspective showing individual parts of the embodiment of FIG. 1 in detail.
FIG. 3 is a cutaway view of an electronic wrist watch showing the mounting of the switch of FIG. 1 from the exterior of the watch housing.

Referring then to FIGS. 1 and 2, an embodiment of a diaphragm type pushbutton actuator switch with self-contained contacts in accordance with the present invention is illustrated. The switch includes a main body designated by the numeral 10 and a pop-in head designated by the numeral 18. In this particular embodiment, the outer shell or casing 11 of the main switch body 10 is comprised of conductive material, preferably a metal such as copper or a copper alloy and the like to serve as a first switch terminal conductively coupled to a conductive diaphragm member 14 comprised of, for example, a copper-nickel alloy. A second conductor member 13 is insulated from the conductive outer casing 11 by an insulative washer member 12. The flexible conductive diaphragm member 14 is normally biased away from contact 13 by diaphragm member 14 to provide an open connection between the housing 11 and the conductor 13. Upon actuation of the pushbutton 19 of the head 18, the lower shaft portion 22 of the pop-in head applies force to the diaphragm member 14 to provide an ohmic path between housing 11 and conductor 13. In this particular embodiment, the pop-in head is comprised of an electrically conductive metal and therefore a flexible insulative diaphragm member 15 is provided between the pop-in head and conductive diaphragm member 14. Another insulating member 17 insulates the pop-in head 18 from making contact with the conductive casing 11. The head 18 includes a retaining member 20 between the shaft portion 21 and the shaft portion 22. The retaining member 20 is preferably a larger diameter portion of the shaft 21 and it is easily seen that the pop-in head 18 is machinable from a single piece of metal such as steel, copper, brass or the like. A detent member 16 having springable prong members is provided in the main switch body 10. Once the pop-in head has been inserted into the main spring body, the prongs 27 of the detent member 16 in conjunction with the retention member 20 retains the head and prevents it from being detached from the main switch body while the head is movable within the main switch body to selectively make or break electrical contact upon activation of the pushbutton 19. In the embodiment in which the outer casing 11 is comprised of a metal and thereby utilized as a terminal, the member 16 is comprised of a non-conductive material such as plastic. Where the housing 11 is comprised of an insulator material and contact is made with the diaphragm member through the housing, for example, the member 16 may be comprised of any spring type metal.

It is readily seen from the switch embodied in FIG. 1, that the main body 10 of the switch may be mounted on a substrate and a housing having an opening in the area 28 placed over the body 10 before the head 18 is inserted therein. The pop-in head is then insertable from the exterior of the housing through an appropriately placed opening. Insertion of the head into the main body 10 causes the prongs 27 of the detent member 16 to expand for passage of the retaining member 20 and then contract for retention of the head by means of member 20. Once the head 18 is retained in the main switch body 10, the head 18 is movable therein to selectively make or break electrical contact between the housing 11 or other terminal means coupled to the diaphragm member 14 and the contact member 13.

In other instances such as the electronic wrist watch shown in FIG. 3, it is desirable, because of the configuration of the housing 25, to insert the main body 10 of the switch into a cavity in the housing provided therefor from outside of the housing with the actuator button removed. The main body may be press-fit, adhesively bonded or otherwise affixed to the housing 25. The conductive diaphragm member 14 is preferably ohmically coupled to the housing 25 by means of a conductive casing 11. When the main body has been placed within the cavity 26 of the housing 25 the pop-in head 18 is inserted in the main body and retained therein by member 16 and retention member 20. Once the head is retained in the main switch body, the head is movable therein to make electrical contact between the housing 25 and the contact 13 which are coupled to an electronic watch circuit in such a manner that whenever the pushbutton 19 is actuated a display of time or date, for example, is provided.

Various embodiments of a pushbutton actuator switch in accordance with the present invention have been described in detail. Since it is obvious that many additional changes and modifications can be made in the abovedescribed details without departing from the nature and spirit of the invention, it is understood that the invention is not to be limited to said details except as set forth in the appended claims.

What is claimed is:

1. A pushbutton actuator switch comprising:

a. a cylindrical housing having an opening at either end thereof;

b. an electrically conductive contact member in said housing extending through the opening at one end thereof;

c. an electrically conductive bias member mounted in said housing;

d. an electrically insulative spacer member mounted in said housing separating said electrically conductive bias member from normally making ohmic contact with said contact member;

e. a pop-in actuator member including a shaft with a pushbutton on one end thereof and a retention member on said shaft spaced from said pushbutton; and f. a unilateral detent member mounted in said housing and having a plurality of bendable spring prong members for passing the shaft and retention member of said actuator member only from the direction of the opening at the other end of said housing; wherein g. said actuator member is retained within said housing by said prong members in cooperation with an edge of said retention member and is movable within said housing to apply force against said conductive bias member for selectively causing said bias member to make ohmic contact with said contact member upon actuation thereof.

2. The switch according to claim 1 wherein said housing is comprised of an electrically conductive material in ohmic contact with said conductive bias member and wherein said spacer member extends through the opening at the one end of said housing, insulating said contact member from said housing.

3. The switch according to claim 2 wherein said actuator member is comprised of electrically conductive material and said switch includes first insulator means electrically insulating said actuator member from said housing and second flexible insulator means electrically insulating said actuator member from said conductive bias member.

4. The switch according to claim 3 wherein said detent member is comprised of electrically insulative material.

5. The switch according to claim 4 wherein said detent member is comprised of plastic.

6. The switch according to claim 1 wherein said detent member is comprised of a hollow cylindrical body having said prong members cut therein angled toward the center line of such cylindrical body.

7. The switch according to claim 6 wherein said edge of said retention member extends from a face of said retention member which is beveled at an angle of 90° with respect to the angle of said prong members.

8. The switch according to claim 1 wherein said retention member and said shaft comprised a single body with the retension member portion having a greater diameter than the shaft portion.

9. A switch assembly including a switch comprising:

a. an electrically conductive housing having a main chamber formed therein and a cylindrical cavity extending from the exterior of said housing to said main chamber;

b. an electrically conductive cylindrical casing having an opening at either end thereof within said cavity and being in ohmic contact with said housing;

c. an electrically conductive contact member in said casing extending through the opening at one end thereof and into the main chamber of said housing;

d. an electrically conductive bias member mounted in said casing and ohmically coupled thereto;

e. an electrically insulative spacer member mounted in said casing separating said electrically conductive bias member from normally making ohmic contact with said contact member and extending through the opening at the one end of said casing, insulating said contact member from said casing;

f. a pop-in actuator member including a shaft with a pushbutton at one end thereof and a retention member on said shaft spaced from said pushbutton; and g. a unilateral detent member mounted in said casing and having a plurality of bendable spring prong members for bending to pass the shaft and retention member of said actuator member only from the exterior of said housing through the opening at the other end of said casing; wherein h. said actuator member is retained within said casing by said prong members in cooperation with said retention member and is movable within said casing to apply force against said conductive bias member for selectively causing said bias member to make ohmic contact with said contact member upon actuation of the pushbutton thereof.

10. The switch assembly according to claim 9 wherein the pushbutton of said actuator member extends within the cavity of said housing and is movable therein.

11. The switch assembly according to claim 9 wherein said casing is press-fit in the cavity of said housing.

12. The switch assembly according to claim 9 wherein said housing is a watch housing and said switch is actuatable to display time.

* * * * *